US009347273B2

(12) United States Patent
Stowe, II

(10) Patent No.: US 9,347,273 B2
(45) Date of Patent: May 24, 2016

(54) METHOD OF ORIENTING A CUTTING ELEMENT

(71) Applicant: Calvin J. Stowe, II, Bellaire, TX (US)

(72) Inventor: Calvin J. Stowe, II, Bellaire, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 14/489,788

(22) Filed: Sep. 18, 2014

(65) Prior Publication Data

US 2015/0000983 A1 Jan. 1, 2015

Related U.S. Application Data

(62) Division of application No. 12/700,845, filed on Feb. 5, 2010.

(51) Int. Cl.
*E21B 10/00* (2006.01)
*E21B 10/46* (2006.01)

(52) U.S. Cl.
CPC ..... *E21B 10/00* (2013.01); *E21B 10/46* (2013.01)

(58) Field of Classification Search
USPC ..... 175/376, 398, 401, 426, 430, 431; 407/102–109, 113–117; 30/353, 357
See application file for complete search history.

(56) References Cited

U.S. PATENT DOCUMENTS 4,978,258 A * 12/1990 Lins ..... 408/187
5,971,676 A 10/1999 Kojima
6,464,434 B2 10/2002 Lynde
6,672,406 B2 1/2004 Beuershausen
7,048,080 B2 5/2006 Griffo et al.
7,121,772 B2 10/2006 Krahula et al.
7,363,992 B2 4/2008 Stowe et al.
7,377,340 B2 5/2008 McDonough
7,543,661 B2 6/2009 Griffo et al.
8,434,572 B2 5/2013 Stowe, II et al.
2002/0139582 A1 10/2002 Caraway et al.
2003/0031520 A1 2/2003 Hintze et al.
2004/0129420 A1* 7/2004 Hart et al. ..... 166/298
2005/0047885 A1 3/2005 Hyatt et al.
2005/0178587 A1 8/2005 Witman, IV et al.
2005/0284659 A1 12/2005 Hall et al.
2007/0107940 A1 5/2007 Lockstedt et al.
2007/0169937 A1 7/2007 Allin et al.
2007/0267221 A1 11/2007 Giroux et al.
2007/0278017 A1* 12/2007 Shen et al. ..... 175/426
2008/0142270 A1 6/2008 Haglund et al.

(Continued)

FOREIGN PATENT DOCUMENTS

GB 2450936 A * 1/2009

OTHER PUBLICATIONS

Cutting & Wear Website, "Cutting Inserts," http://www.cwuk.com/page390.asp; accessed Jan. 5, 2010.

(Continued)

*Primary Examiner* — Taras P Bemko
(74) *Attorney, Agent, or Firm* — Cantor Colburn LLP

(57) ABSTRACT

A method of orienting a cutting element includes, configuring the cutting element so that gravitational forces acting thereon against a support surface bias the cutting element toward a specific orientation relative to the support surface. The specific orientation is such that at least one support and at least one edge of a gilmoid formed by intersections of surfaces of the gilmoid contact the support surface.

11 Claims, 6 Drawing Sheets

(56) References Cited

U.S. PATENT DOCUMENTS

| | | | | |
|---|---|---|---|---|
| 2008/0164071 | A1 | 7/2008 | Patel et al. | |
| 2008/0166191 | A1* | 7/2008 | Andersson | B23C 5/2208 407/103 |
| 2008/0193233 | A1* | 8/2008 | Park | B23C 5/2208 407/104 |
| 2008/0264690 | A1 | 10/2008 | Khan et al. | |
| 2009/0022553 | A1* | 1/2009 | Morrison | B32B 27/1677 407/105 |
| 2009/0032307 | A1 | 2/2009 | Meyer et al. | |
| 2009/0260878 | A1 | 10/2009 | Morley et al. | |
| 2009/0283326 | A1 | 11/2009 | Oothoudt et al. | |
| 2011/0192653 | A1 | 8/2011 | Stowe, II et al. | |
| 2011/0203856 | A1 | 8/2011 | Lynde et al. | |
| 2011/0308865 | A1 | 12/2011 | Stroud et al. | |
| 2012/0073880 | A1 | 3/2012 | Lynde et al. | |

OTHER PUBLICATIONS

Cutting & Wear—Hardfacing & Engineering for the Energy Industry; "Materials, equipment and services for oil companies"; Product Catalog; www.cwuk.com, South Yorkshire, United Kingdom.

Notification of Transmittal of the International Search Report and the Written Opinion of the International Searching Authority; PCT/US2011/023698; Korean International Patent Office; Mailed Sep. 27, 2011; ISR 5 pages; WO 3 pages.

Notification of Transmittal of the International Search Report and the Written Opinion of the International Searching Authority; PCT/US2013/039393; Korean International Patent Office; Mailed Sep. 17, 2013; 13 pages.

* cited by examiner

METHOD OF ORIENTING A CUTTING ELEMENT

CROSS-REFERENCE TO RELATED APPLICATION

This application is a division of U.S. patent application Ser. No. 12/700,845, filed Feb. 5, 2010, the disclosure of which is incorporated by reference herein in its entirety.

BACKGROUND

Cutting tools, such as mills used in downhole applications, for example, can be made with a plurality of cutting elements that are adhered to a surface of a tool. The cutting elements can be randomly shaped particles made by fracturing larger pieces. Alternately, cutting elements can be precisely formed into repeatable shapes using processes such as machining and molding, for example. Regardless of the process employed to make the individual cutting elements the elements are typically adhered to the mill with random orientations. These random orientations create disparities in maximum heights relative to a surface of the mill. Additionally, large disparities may exist between the heights of the portions of the cutting elements that engage the target material during a cutting operation. Furthermore, angles of cutting surfaces relative to the target material are randomized and consequently few are near preferred angles that facilitate efficient cutting. Apparatuses and methods to lessen the foregoing drawbacks would therefore be well received in the industry.

BRIEF DESCRIPTION

Further disclosed herein is a method of orienting a cutting element. The method includes, configuring the cutting element so that gravitational forces acting thereon against a support surface bias the cutting element to an orientation relative to the support surface in which at least one support and at least one side of a polygon of a gilmoid contact the support surface.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
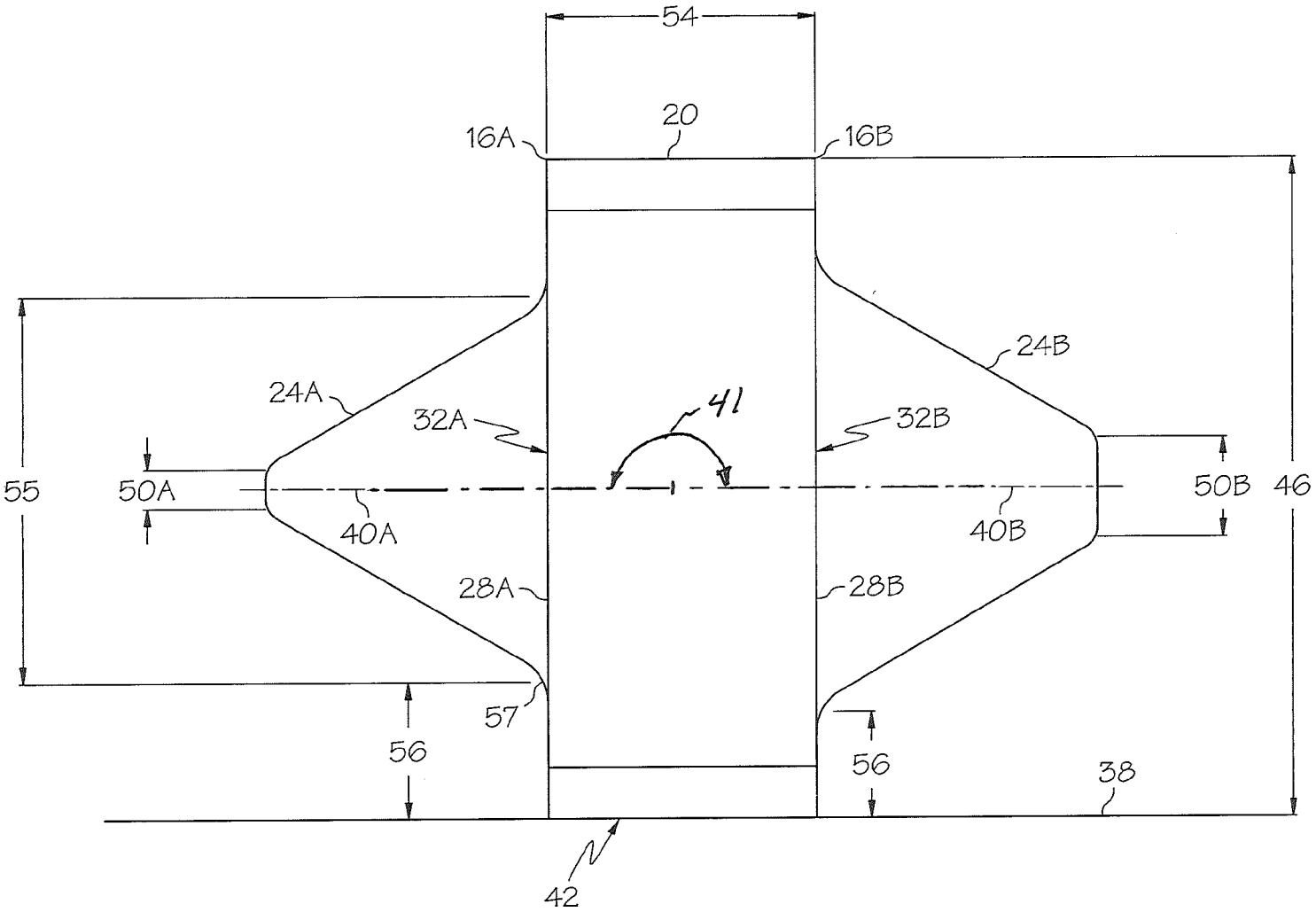
FIG. 1 depicts a side view of a cutting element disclosed herein.

Referring to FIG. 1, an embodiment of a cutting element disclosed herein is illustrated at 10. The cutting element 10 includes, a central portion 20 disclosed herein as a gilmoid, as will be described in detail below with reference to FIGS. 5 and 6, defining a plurality of cutting edges 16A, 16B, and two supports 24A and 24B that extend beyond surfaces 32A and 32B that define certain volumetric boundaries of the gilmoid 20. In this embodiment the supports 24A and 24B are not symmetrical to one another to produce a biasing force in response to gravity acting thereon toward a surface 38, such that one of the supports 24A, 24B and one of the cutting edges 16A, 16B are in contact with surface 38. Additionally, the supports 24A, 24B in this embodiment have a pyramidal shape.

Figure 2:
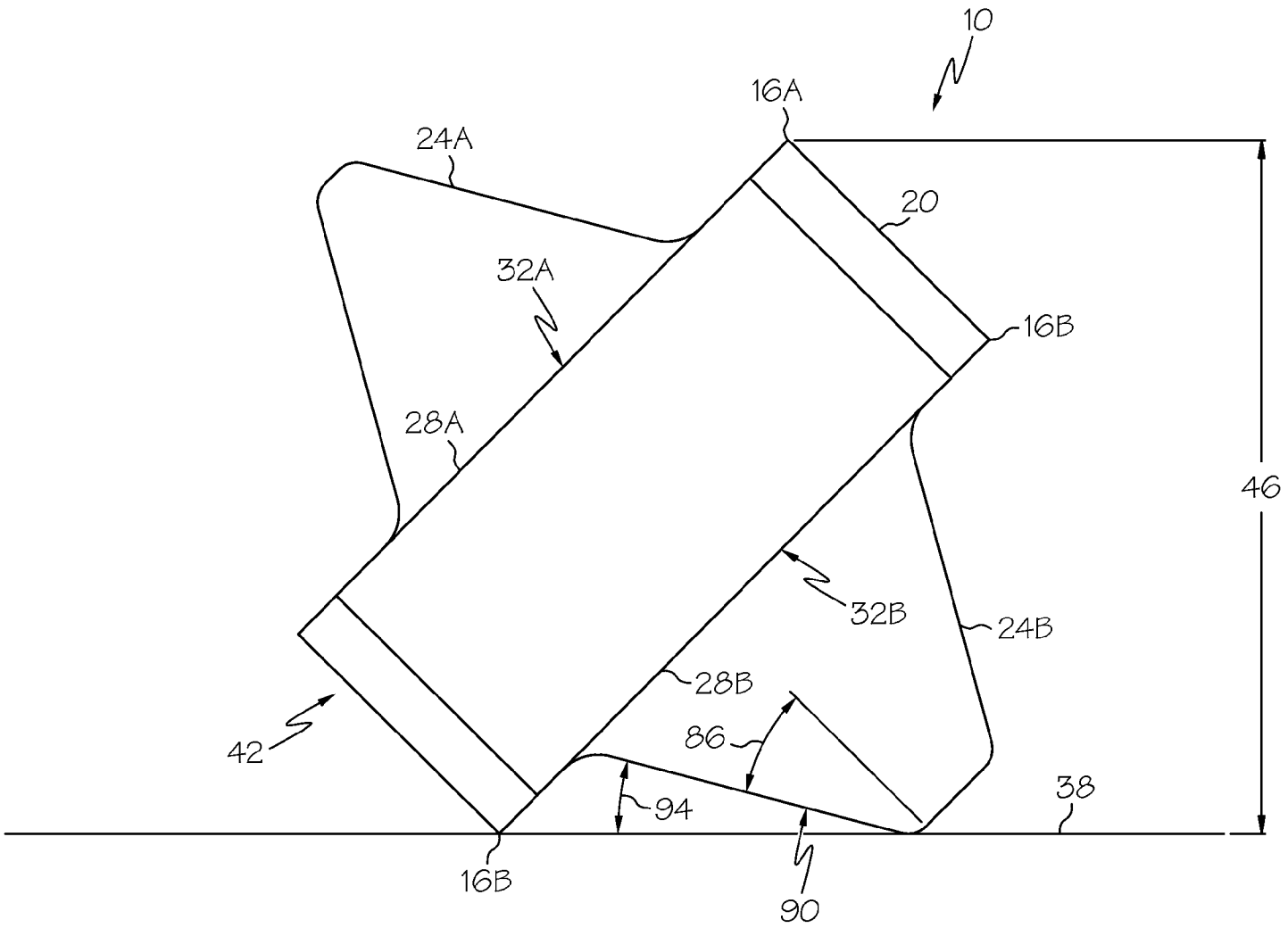
FIG. 2 depicts another side view of the cutting element of FIG. 1, shown resting at an alternate orientation on a surface.
Figure 3:
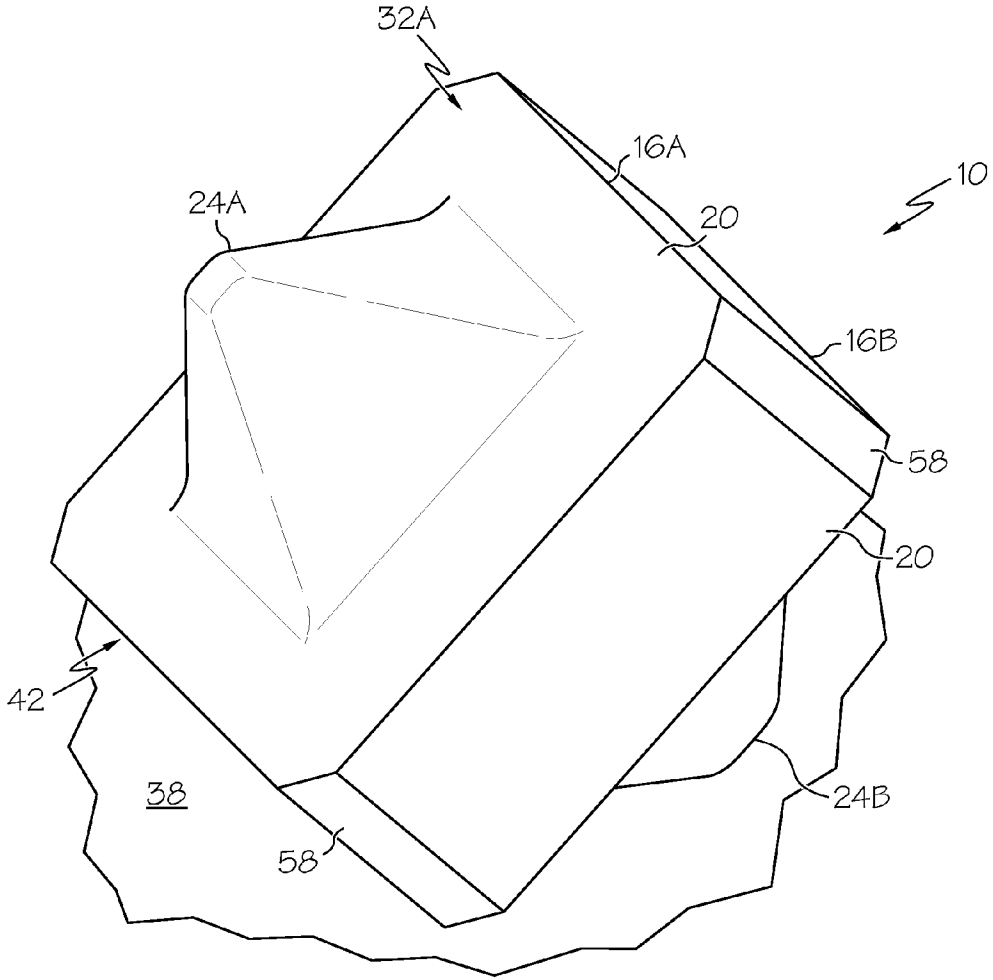
FIG. 3 depicts a perspective view of the cutting element of FIGS. 1 and 2, shown resting at the orientation of FIG. 2.

Referring to FIGS. 2 and 3, the biasing forces tend to cause the cutting element 10 to reorient from the position illustrated in FIG. 1 to the position illustrated in FIGS. 2 and 3. The cutting element 10, as illustrated in FIGS. 2 and 3, is resting on the surface 38 such that both the support 24B and one of the cutting edges 16B is in contact with the surface 38. The cutting edges 16A, in this position, are oriented with the surface 32A at an approximately 45 degree (and preferably between 35 and 55 degrees) angle relative to the surface 38, and represent a preferred cutting orientation that can cut with greater efficiency than alternate angles. In contrast, the cutting element 10 in FIG. 1 is positioned such that just one face 42, defined between the two cutting edges 16A and 16B, is in contact with the surface 38. In this position a longitudinal axes of the gilmoid 20 is substantially parallel with the surface 38. Additionally, although axes 40A, 40B of the supports 24A, 24B are illustrated herein with an angle 41 of 180 degrees between them, angles of 120 degrees or more are contemplated.

The cutting element 10 is further geometrically configured so that when the cutting element 10 is resting on the surface 38, regardless of its orientation, a dimension 46 to a point on the cutting element 10 furthest from the surface 38 is substantially constant. This assures a relatively even distribution of cutting forces over a plurality of the cutting elements 10 adhered to the surface 38.

The foregoing structure allows a plurality of the cutting elements 10 to be preferentially oriented on the surface 38 prior to being fixedly adhered to the surface 38. While orientations of each of the cutting elements 10 is random in relation to a direction of cutting motion the biasing discussed above orients a majority of the cutting elements 10 as shown in FIGS. 2 and 3 relative to the surface 38. Having a majority of the cutting elements 10 oriented as shown in FIGS. 2 and 3 improves the cutting characteristics of a cutter employing these cutting elements 10 over cutters employing non-biasing cutting elements.

The supports 24A and 24B illustrated herein are geometrically asymmetrical, as is made obvious by the difference in widths 50A and 50B of the supports 24A and 24B, respectively. This asymmetry creates the asymmetrical bias discussed above in response to gravitational forces acting on the cutting element 10 in a direction parallel to the surfaces 32A, 32B. Alternate embodiments are contemplated that have supports that are geometrically symmetrical while providing the asymmetrical bias with gravity. A difference in density between such supports is one way to create such an asymmetrical gravitational bias with geometrically symmetrical supports.

A width 54 of the central portion 20, defined between the planes 28A and 28B, can be set large enough to provide strength sufficient to resist fracture during cutting while being small enough to allow the gravitational asymmetrical bias on the cutting element 10 to readily reorient the cutting element 10 relative to the surface 38 and be effective as a cutting element.

Additionally in this embodiment, by making a base dimension 55, defined as where the supports 24A, 24B intersect with the surfaces 32A, 32B, smaller than the dimension 46, a right angled intersection is defined at the cutting edges 16A, 16B. A distance 56 between an intersection 57 of the supports 24A, 24B with the surfaces 32A, 32B and the faces 42, 58, 62 provides a space where the material being cut can flow and can create a barrier to continued propagation of a crack formed in one of the cutting edges 16A, 16B beyond the intersections 57. Preferably, the base dimension 55 is sized to be between 40 and 80 percent of the dimension 46 and more preferably about 60 percent. The 40 to 80 percent requirement combined with the 35 to 55 degree angle limitation discussed above results in flank angle 86 values of between about 15.6 and 29 degrees wherein the flank angle 86 is defined as the angle between a flank face 90 and an axis of the support that is substantially perpendicular to the at least one plan 32B. Additionally, the flank face 90 forms an angle 94 of between about 19.4 and 26 degrees relative to the surface 38.

Figure 4:
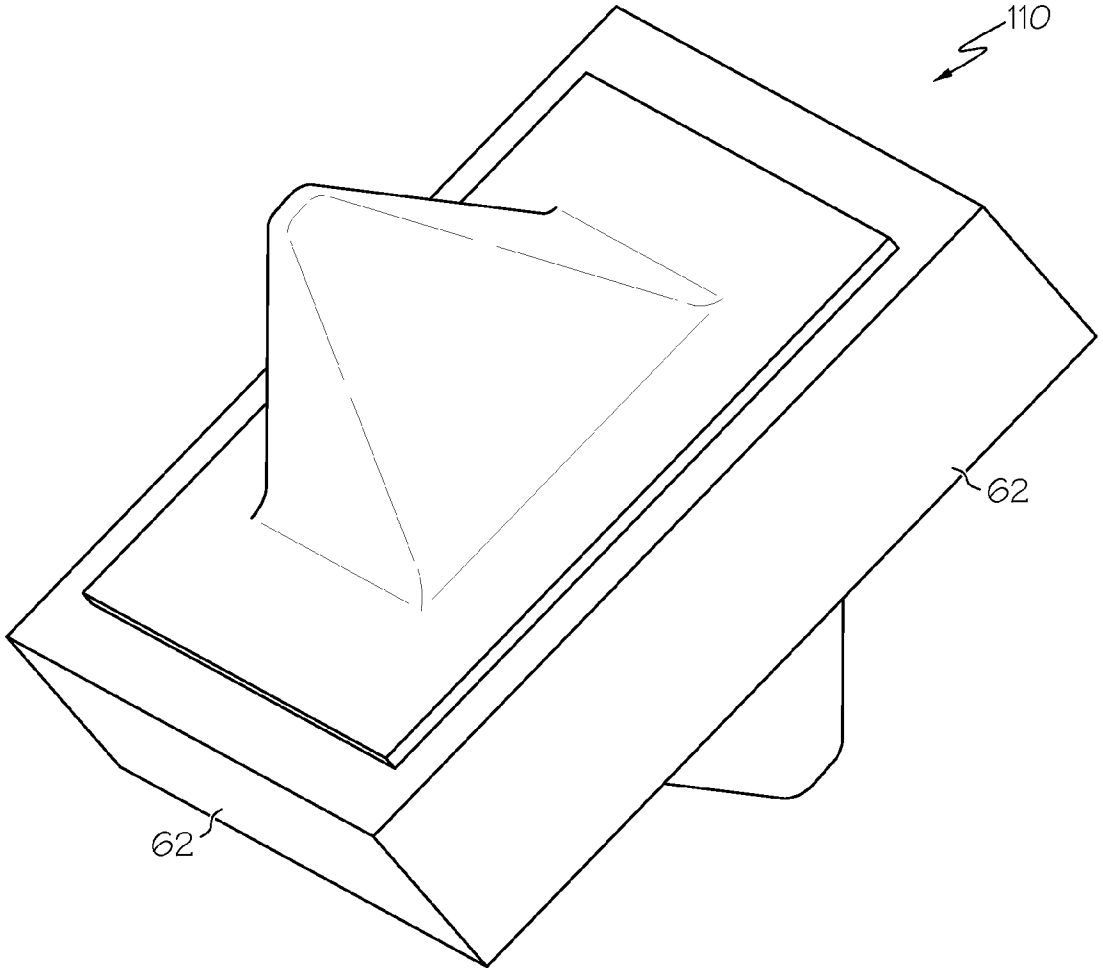
FIG. 4 depicts a perspective view of an alternate embodiment of a cutting element disclosed herein.

Referring to FIG. 3, additional faces 58 defined between the cutting edges 16A and 16B can be incorporated as well. In fact, any number of faces 42, 58 can be provided between the cutting edges 16A and 16B thereby forming a polygonal prism of the central portion 20, including just four faces 62 as illustrated in FIG. 4 in an alternate embodiment of a cutting element 110 disclosed herein.

The cutting elements 10, 110 disclosed herein may be made of hard materials that are well suited to cutting a variety of materials including, for example, those commonly found in a downhole wellbore environment such as stone, earth and metal. These hard materials, among others, include steel, tungsten carbide, tungsten carbide matrix, polycrystalline diamond, ceramics and combinations thereof. However, it should be noted that since polycrystalline diamond is not a required material some embodiments of the cutting elements 10, 110 disclosed may be made of hard materials while excluding polycrystalline diamond therefrom.

Figure 6:
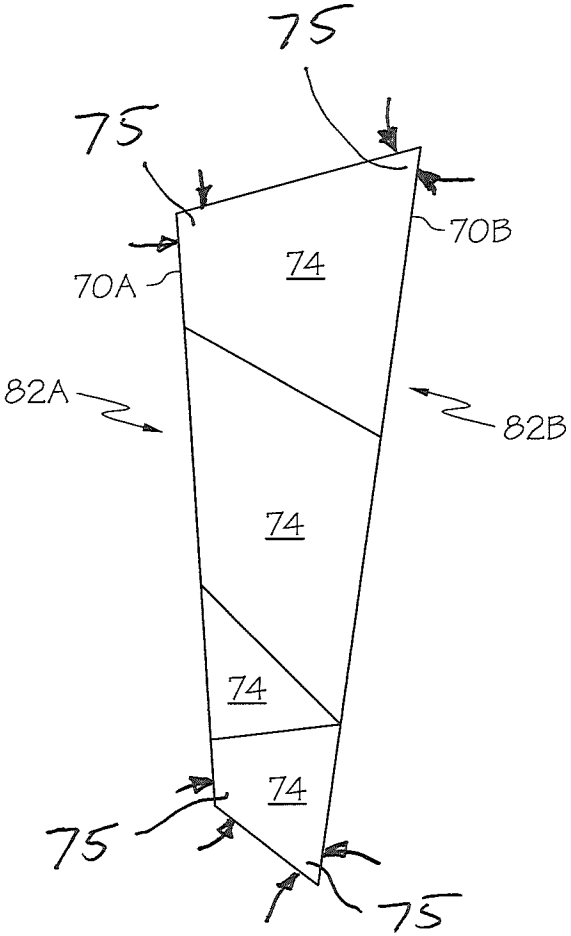
FIG. 6 depicts a side view of the central portion of the cutting element of FIG. 5.
Figure 5:
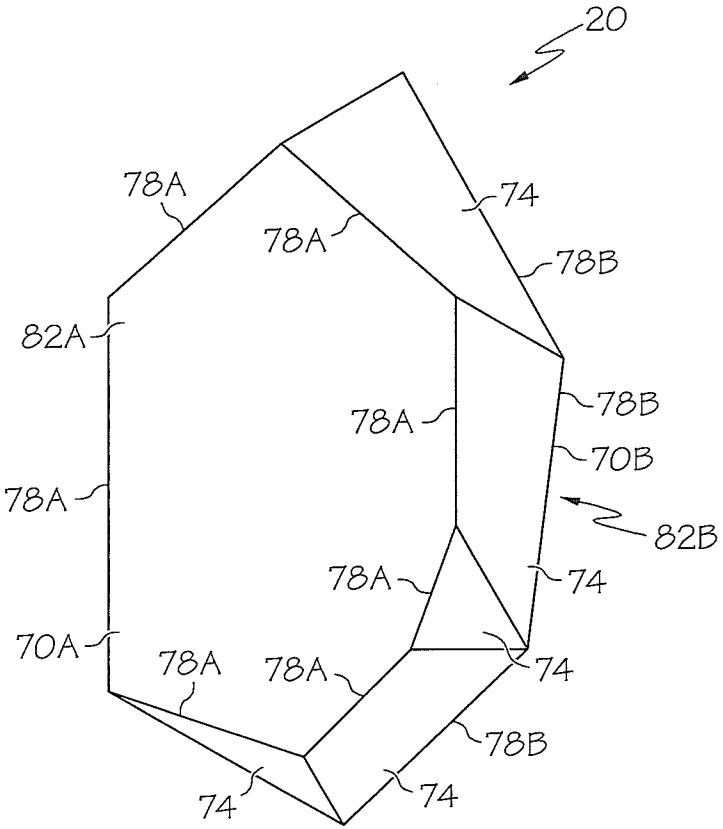
FIG. 5 depicts a perspective view of a central portion of the cutting element.

Although the embodiments discussed above are directed to a central portion 20 that is a polygonal prism, alternate embodiments can incorporate a central portion 20 that has fewer constraints than is required of a polygonal prism. As such, the term gilmoid has been introduced to define the requirements of the central portion 20. Referring to FIGS. 5 and 6, the gilmoid 20 is illustrated without supports 24A, 24B shown. The gilmoid 20 is defined by two polygons 70A, 70B with surfaces 74 that connect sides 78A of the polygon 70A to sides 78B of the other polygon 70B. The two polygons 70A, 70B can have a different number of sides 78A, 78B from one another, and can have a different area from one another. Additionally, planes 82A, 82B, in which the two polygons 70A, 70B exist, can be parallel to one another or can be nonparallel to one another, as illustrated. In embodiments wherein the planes 70A and 70B are not parallel to one another such is shown in FIG. 6, included angles 75 between the surfaces 74 and the planes 70A and 70B can be in a range of about 80 to 100 degrees.

Figure 7:
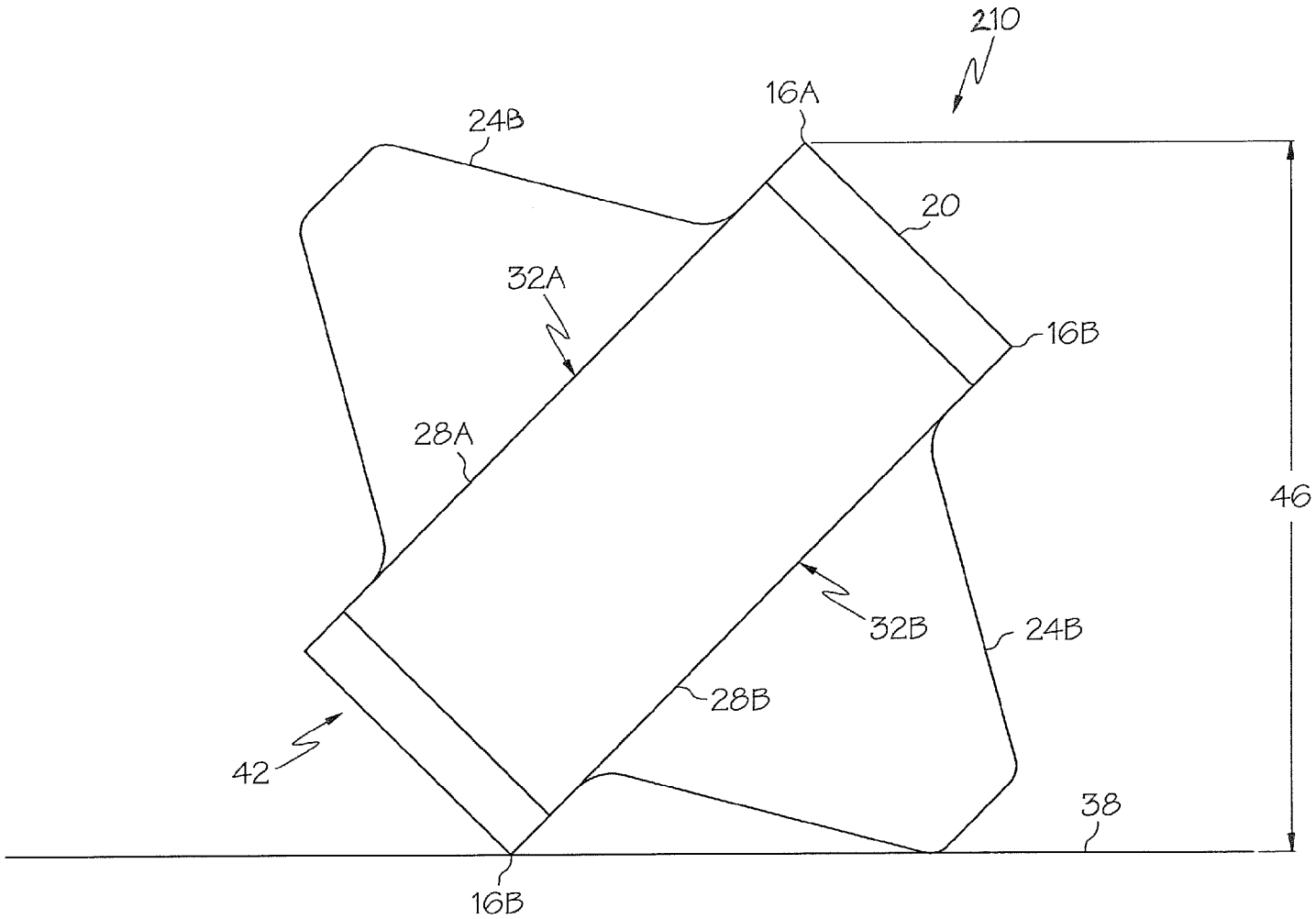
FIG. 7 depicts a side view of an alternate embodiment of a cutting element disclosed herein.

Referring to FIG. 7, an alternative embodiment of a cutting element disclosed herein is illustrated at 210. Many of the characteristics of the element 210 are similar to the element 10 and as such like features are numbered alike and are not described again herein. Unlike the element 10, however, the element 210 includes two supports 24B that extend from opposing surfaces 32A and 32B of the gilmoid 20. The two supports 24B are dimensioned the same as one another thereby making the cutting element 210 symmetrical. An embodiment wherein the supports 24A and 24B (shown in FIG. 2) may be geometrically symmetrical is also described above with reference to FIG. 2.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of orienting a cutting element, comprising configuring the cutting element having a gilmoid having a plurality of edges formed by intersections of surfaces, and at least one support extending directly from at least one of the surfaces so that gravitational forces acting thereon against a planar support surface preferentially bias the cutting element toward an orientation relative to the planar support surface in which the at least one support and at least one of the plurality of edges contact the planar support surface with the at least one of the surfaces extending at an acute angle relative to the planar support surface in preparation for being fixedly adhered to the planar support surface.

2. The method of orienting a cutting element of claim 1, wherein the configuring the cutting element includes distributing weight of the cutting element.

3. The method of orienting a cutting element of claim 1, further comprising distributing weight of the cutting element asymmetrically.

4. The method of orienting a cutting element of claim 3, further comprising distributing weight of the cutting element asymmetrically beyond a volume of the gilmoid.

5. The method of orienting a cutting element of claim 3, further comprising distributing weight asymmetrically by altering density of different portions of the cutting element.

6. The method of orienting a cutting element of claim 3, further comprising distributing weight asymmetrically by selecting different densities for the at least one support and another of the at least one support.

7. The method of orienting a cutting element of claim 1, wherein the configuring the cutting element includes geometrically shaping the cutting element.

8. The method of orienting a cutting element of claim 1, further comprising geometrically shaping the cutting element asymmetrically.

9. The method of orienting a cutting element of claim 1, further comprising geometrically shaping the cutting element such that a shape of one of the at least one supports is different than a shape of another of the at least one supports.

10. The method of orienting a cutting element of claim 9, wherein the difference in shape of the one of the at least one supports includes a difference in size of a base of another of the at least one supports.

11. The method of orienting a cutting element of claim 1, wherein the acute angle defines an angle of between about 35 degrees and about 55 degrees relative to the planar support surface.

* * * * *